United States Patent [19]

Backstein et al.

[11] Patent Number: 4,612,858

[45] Date of Patent: Sep. 23, 1986

[54] FUSE FOR A SATELLITE PROJECTILE

[75] Inventors: Guenter Backstein, Meerbusch; Hans W. Unger, Krefeld, both of Fed. Rep. of Germany

[73] Assignee: Rheinmetall GmbH., Duesseldorf, Fed. Rep. of Germany

[21] Appl. No.: 651,445

[22] Filed: Sep. 17, 1984

[30] Foreign Application Priority Data

Sep. 15, 1983 [DE] Fed. Rep. of Germany ..... 3333312

[51] Int. Cl.[4] ..... F42C 15/26

[52] U.S. Cl. ..... 102/245; 102/237; 102/240; 102/476

[58] Field of Search ..... 102/244, 245, 237, 239, 102/240, 254, 236, 221, 227, 500, 489

[56] References Cited

U.S. PATENT DOCUMENTS

| | | | |
|---|---|---|---|
| 1,229,669 | 6/1917 | Stuart | 102/245 |
| 1,648,603 | 11/1927 | Barker | 102/245 X |
| 2,537,855 | 1/1951 | Porter | 102/245 X |
| 2,790,390 | 4/1957 | Baker | 102/245 |
| 3,264,995 | 8/1966 | Libby et al. | 102/245 |
| 3,371,608 | 3/1968 | Webb | 102/245 |
| 3,886,868 | 6/1975 | Webb | 102/245 |
| 3,913,483 | 10/1975 | Woltermann | 102/476 |
| 4,242,963 | 1/1981 | Ziemba | 102/245 X |

FOREIGN PATENT DOCUMENTS 698633 11/1940 Fed. Rep. of Germany ..... 102/242

*Primary Examiner*—David H. Brown

[57] ABSTRACT

The invention relates to a fuse for a satellite projectile that is expelled from a carrier projectile. In order to maintain a defined ignition time within narrow tolerances, despite initial blind position of the fuse immediately after the expulsion of the satellite projectile, the firing pin 7 is centrally arranged in the interior of a key-shaped cover 12 which is movably disposed in the interior of a housing 1. The wall 12' of the cover 12 has a plurality of recesses 5' into which there engage a corresponding number of locking pins 5 mounted on sheet metal springs 4. These springs 4 are radially outwardly swingable and are secured to the housing 1. The locking pins 5 prevent an axial movement of the firing pin 7 during the safety inactive-position-period and prevent thereby a radial outward swinging of the detonator support 15 into the ignition position. The lockings pins 5 are capable of being swung outwardly in a radial direction out of the wall of the cover 12 only after the unwinding of a wound band 11, whereby the ignition process can be introduced.

9 Claims, 12 Drawing Figures

FUSE FOR A SATELLITE PROJECTILE

BACKGROUND OF THE INVENTION

The invention relates to a fuse for a satellite projectile. Such fuses generally have an ignition needle or firing pin which is axially slidably movably mounted in a housing and which has a safety mechanism mounted thereon in the form of a wound band and also a detonator support member which swings radially outwardly due to centrifugal forces caused by the spin of the projectile.

A "satellite projectile" in the sense of this invention means one of a plurality of projectiles or grenades which are transported over a target area by means of a carrier projectile and are expelled from the latter when the carrier projectile has reached the target area.

A fuse of this type is disclosed in U.S. Pat. No. 3,913,483. Such fuse has a firing pin which is screwed into the fuse housing when in a safety position. The firing pin, when in the safety position engages into a slider so that the slider locks it and prevents it from swinging radially outwardly. The end of the screwed in firing pin which faces away from the slider is joined to a stabilizing band or ribbon, which unfolds or unwinds after expulsion of the grenade (satellite projectile) and exerts for the purpose of arming the fuse a rotational torque on the screwed in firing pin. In this known arrangement there frequently occur, however, undesirable time deviations during arming of the fuses of the individual grenades as result of fluctuations of airstreaming against the unfolding ribbon and spin of the projectile which cause differences in the torque forces and deviations in the frictional resistance in the screw thread contact between the thread in the fuse housing and the thread on the firing pin. This is particularly disadvantageous when the satellite projectiles are expelled from the carrier projectile at relatively low altitude and there remains only a comparatively short time interval until target impact.

SUMMARY OF THE INVENTION

It is a general object of this invention to provide an improved fuse which functions substantially more exactly in satellite projectiles or grenades of the aforedescribed type so that the arming time for the fuse can be adjusted to substantially narrower tolerances.

BRIEF DESCRIPTION OF THE DRAWINGS

While certain objects, features, and advantages of the present invention have been specifically pointed out, others will occur to those skilled in the art by examining the following description taken in connection with the accompanying drawings.

DETAILED DESCRIPTION

Figure 1:
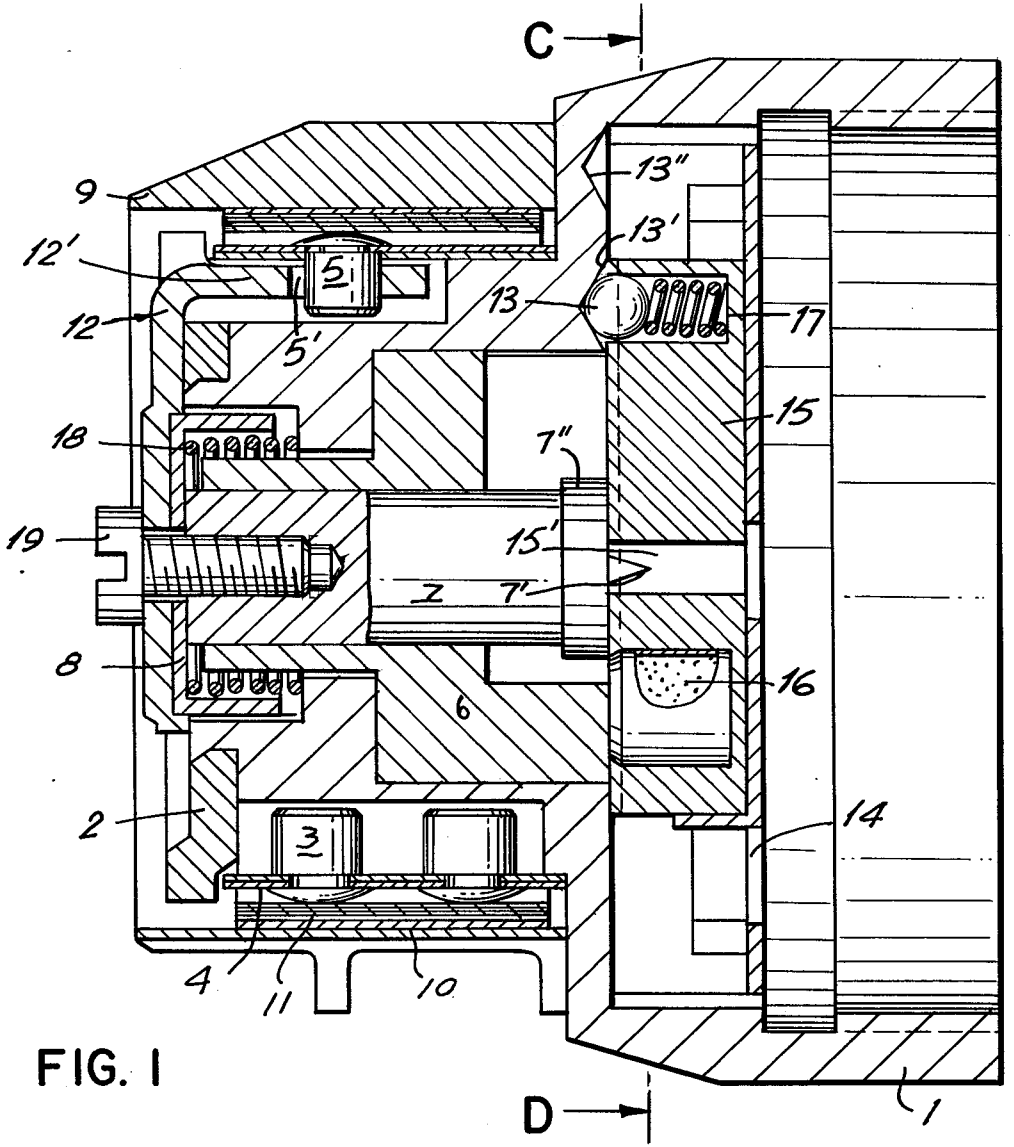
FIG. 1 is a cross-sectional view of a first embodiment of the invention along plane A-B of FIG. 3.
Figure 2:
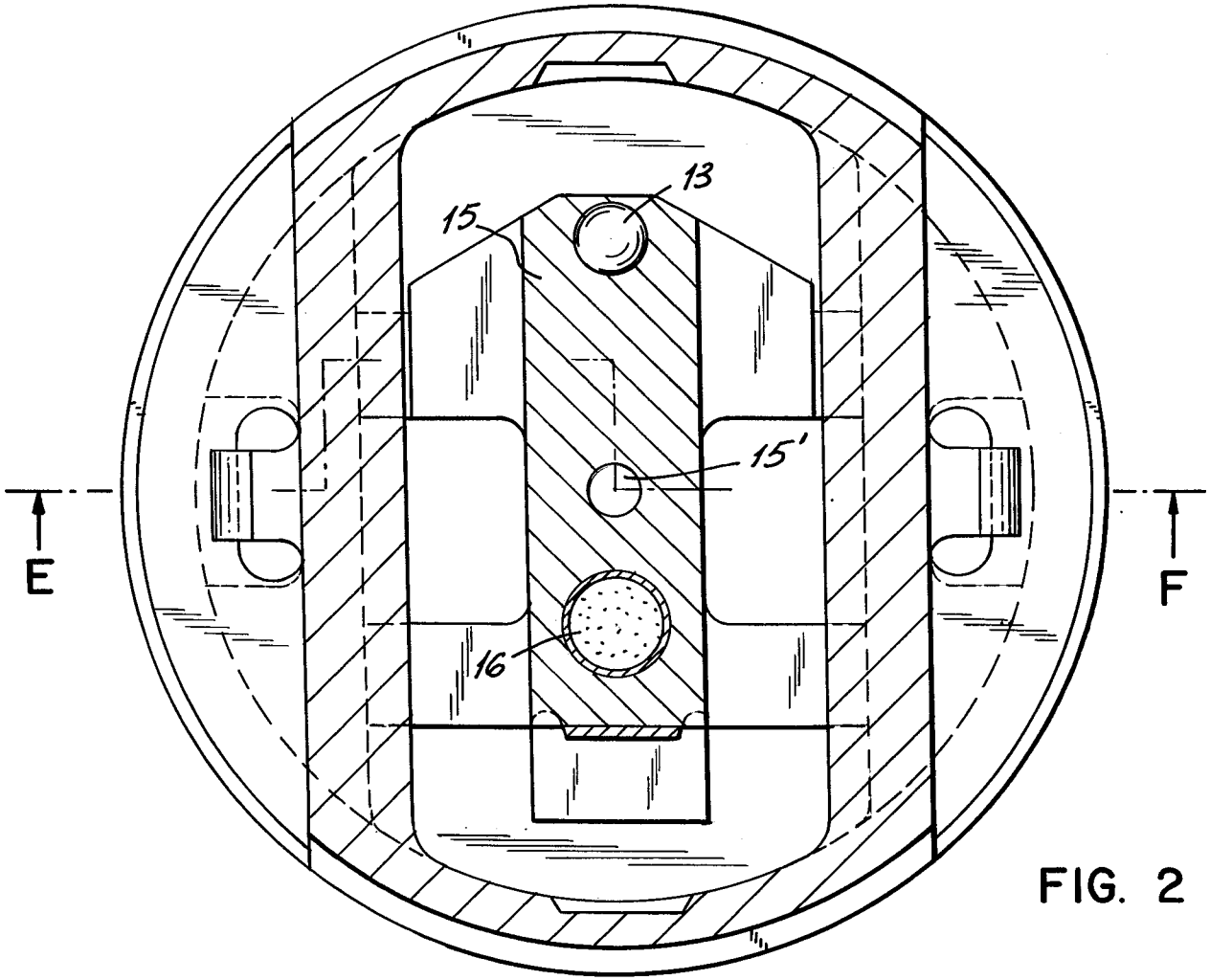
FIG. 2 is a cross-sectional view along plane C-D of FIG. 1.
Figure 3:
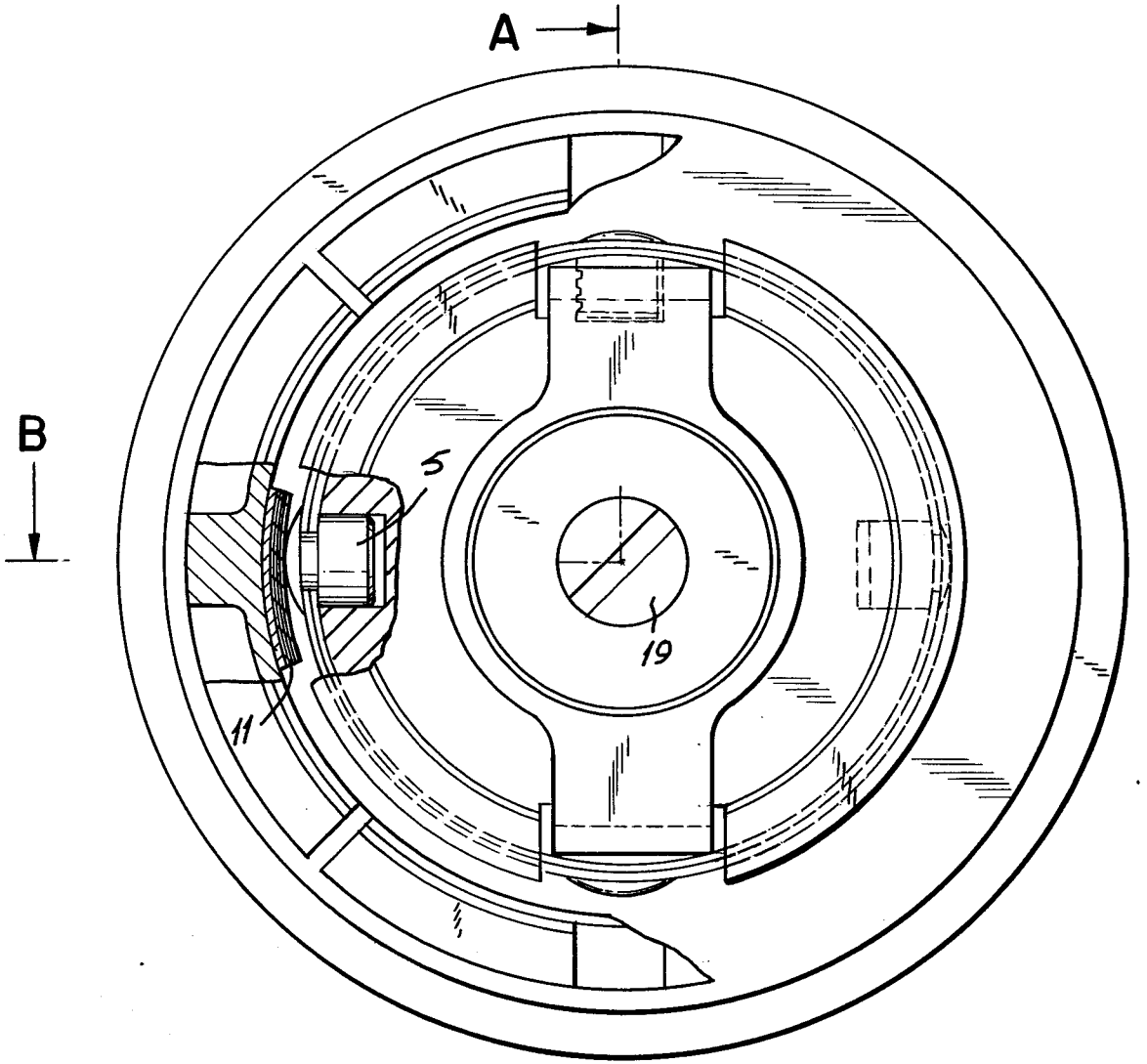
FIG. 3 is a plan view partially in cross-section of the fuse in accordance with FIG. 1.
Figure 4:
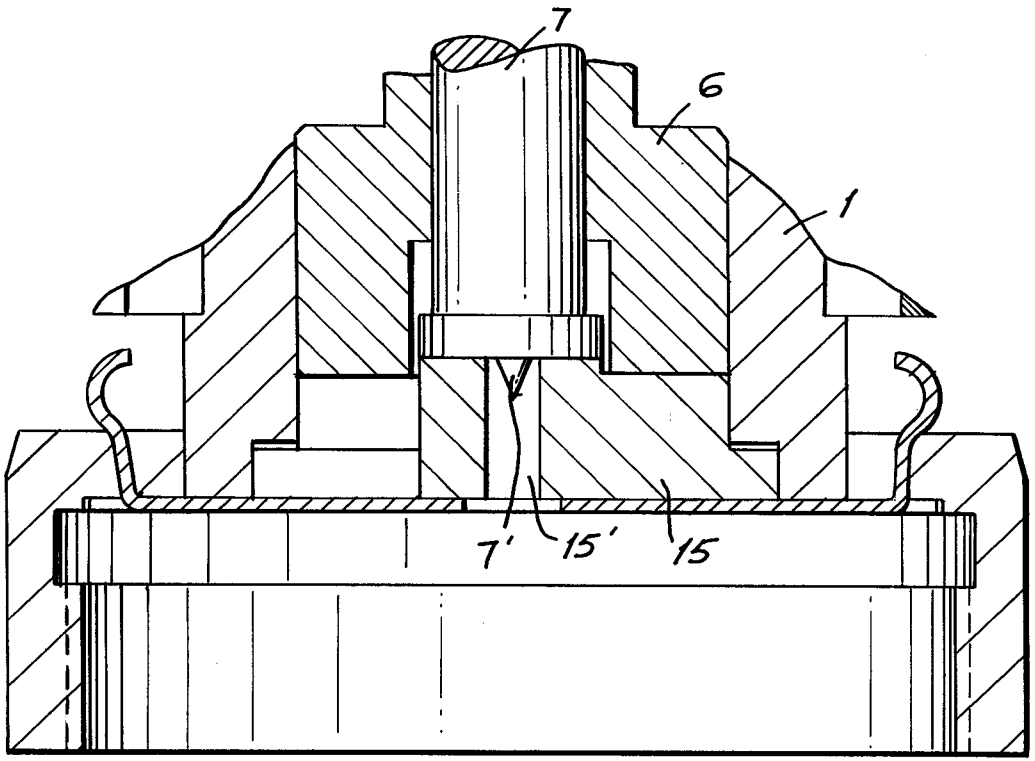
FIG. 4 is a partial cross-sectional view of the fuse of the invention along plane E-F in FIG. 2.

There is illustrated in cross-section in FIG. 1 a first embodiment of the fuse of the invention along plane A-B of FIG. 3. Only those parts of the fuse of the satellite projectile of the invention are illustrated which are required for an understanding of the invention. The operational parts of the fuse are mounted in a housing 1. The type of satellite projectile referred to herein is mounted in large numbers in a carrier projectile (not illustrated) arranged in a plurality of layers one behind the other in the useful payload chamber of the carrier projectile (also not illustrated). These large number of satellite projectiles are transported by the carrier projectile over a target area and are then expelled from the carrier projectile. The satellite projectiles then descend onto the target area. These projectiles may be provided with sensors which detect targets automatically and effect detonation at a preselected distance from the target.

It is important to assure that when the large number of satellite projectiles are expelled from the carrier vehicle they do not self-destruct in case they accidently touch each other. It follows from this operational requirement that the fuses are only then armed when the satellite projectiles are spaced at a sufficient distance from each other after expulsion from the carrier projectile. Thus it is a desired design feature to provide a safety mechanism of the type used in artillery shells.

A key-shaped cover 12 is movably mounted in the housing 1 and a firing pin or needle 7 is centrally mounted in the housing 1 and is secured to the cover 12 in manner as will be described in detail hereafter. The wall 12' of the cover 12 has recesses 5' into which there radially extend pins 5 which are spring fixedly mounted on spring sheet metal bands 4 which bias the pins 5 radially inwardly. These bands 4 are secured to the housing 1. The pins 5 prevent the cover 12 jointly with the firing pin 7 mounted thereon by means of the screw 19, from lifting off the detonator support 15 via the pressure exerted by the coil spring 18. The needle point 7' of the firing pin 7 projects into the through-bore 15' in the position illustrated in FIG. 1. A wound band 11 is wound around the locking pins 5 in several layers thereby secure them in an operative holding position in the forward portion of the housing 1. The wound band 11 is surrounded by a safety ring 10 and a transport safety ring 9 to prevent a radial outward displacement of the band 11 and pins 5. The rings 9 and 10 are clampingly mounted on the housing and this clamp connection is released by the centrifugal forces of the spinning projectile. The firing pin 7 is concentrically surrounded by a percussion mass 6. This percussion mass 6 is formed as a hollow cylinder with stepped outer diameter. The firing pin 7 has its nose point 7' project into the through-bore 15' of the detonator support 15 thereby preventing a radially outward migration of the slidably arranged detonator support 15. This support is additionally secured by a stop against an undesirable radial outward movement at preselected points of time. This stop includes a ball 13 which is spring-loaded by a spring 17 which engages in a first recess 13' in the housing 1 when the fuses are in the safety position.

The first embodiment of the fuse of this invention operates as follows: In view of the fact that the carrier projectile rotates about its longitudinal axis at the point in time at which the satellite projectiles are being expelled, a spin is also imparted to the expelled satellite projectiles. Thereby the transport safety ring 9 and the safety ring 10 are opened to such an extent that the clamp-seating of both of these parts on the housing 1 of the fuse is released. Thereby the wound band 11, preferably consisting of a textile material, unravels in the airstream and is unwound layer by layer, which requires a certain period of time. During this period of time the fuse remains completely safe (inoperative), i.e. the firing pin 7 and the detonator support 15 remain in the position illustrated in FIG. 1. After the complete unwinding of the wound band 11 the latter can either be thrown off or, for purposes of further flight stabilization of the satellite projectile, remain affixed thereto. Now the unilaterally affixed spring sheet metal bands 4 can flex outwardly in a radial direction and thereby release the cover 12 in view of the fact that the locking pins 5 secured to the spring sheet metal bands 4 release the recesses 5'. The cover 12 moves now in an axial direction a small distance away from the housing 1 of the fuse under the influence of air-streaming and by the action of coil spring 18 and thereby lifts the firing pin 7, fixed to the cover 12, out of the bore 15' of the detonator support 15 until the collar 7'' of the pin 7 contacts or impacts on the percussion mass 6. This movement is effected as a result of the influence of air-streaming forces and is also supported by the action of the coil spring 18. As a result of the centrifugal force that is being engendered by the rotation of the satellite projectile the now released detonator support 15 moves, after overcoming the stop action of the ball 13 in the first recess 13', in a radially outward direction until the ball 13 engages in the second recess 13'' in the housing 1 and the detonator support 15 is fixed in this second position by interengagement of ball 13 and recess 13''. Thereby the detonator 16 is now in alignment with the firing pin nose point 7' of the firing pin 7 which, via the action of the coil spring 18 bears still against the percussion mass 6 and is held a distance from the detonator 16.

The radially outwardly swung spring sheet metal bands 4 act in a particularly advantageous manner as spin brakes, whereby the rotation of each satellite projectile after its expulsion is reduced to such an extent that the still remaining rotation has as little as possible influence on the active portion of the satellite projectile which is generally constructed as a hollow charge. Therefore, with this construction of the fuse a secure ignition of an effective charge is even then reached when the satellite projectile no longer rotates at the time of target impact.

Upon impact on a target the percussion mass 6 slides forwardly jointly with the firing pin 7 and the cover 12 secured thereto due to dynamic inertial forces, counter to the force of the comparatively weak coil spring 18, in a direction in which the firing pin 7 with its firing pin nose point 7' is in alignment with the detonator charge 16. The large total percussion mass, formed by the parts 6, 7 ad 12, affords, a high reliability for ignition, in conjunction with a good guiding of the firing pin 7, even when impacting on soft targets, for example sand, snow or mud.

Figure 5:
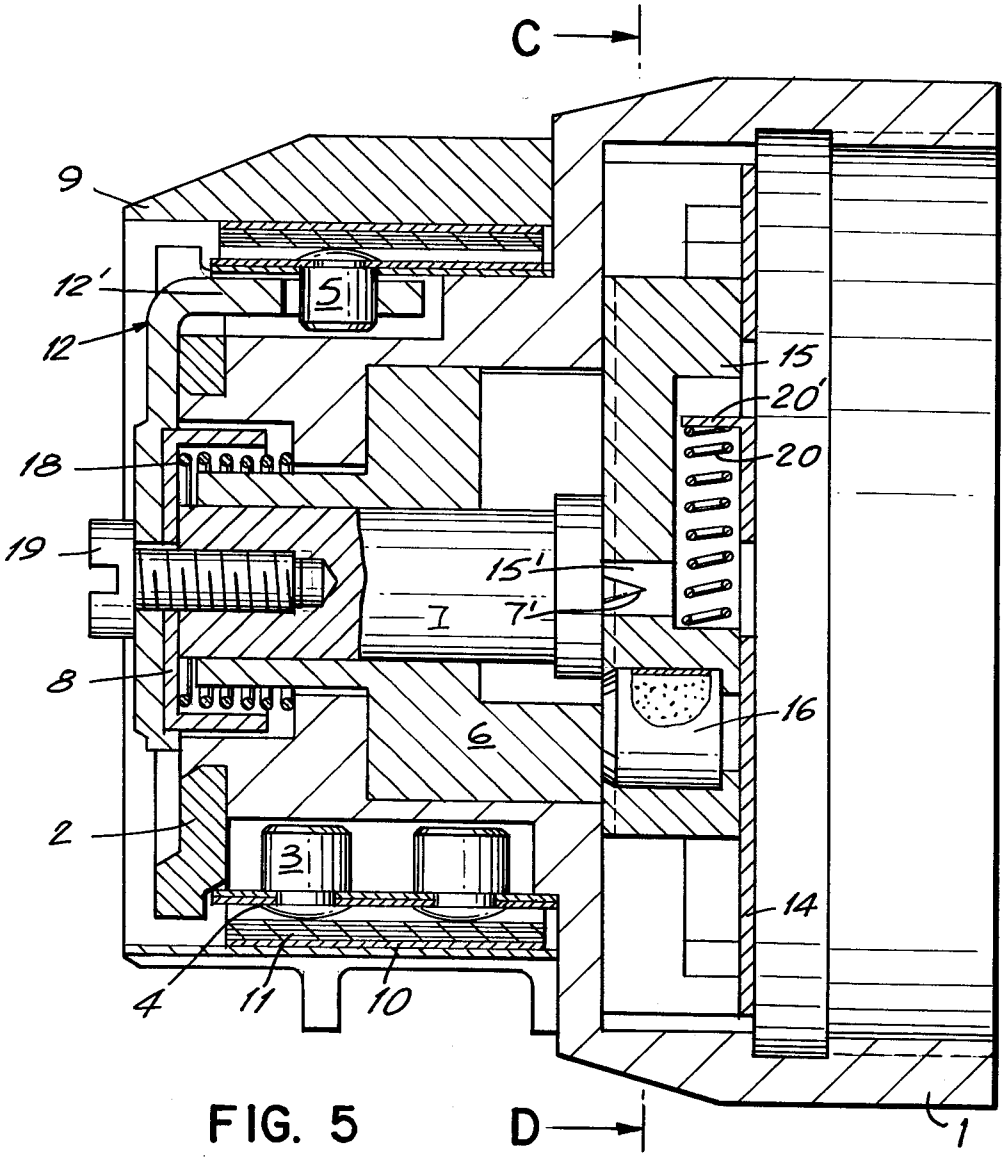
FIG. 5 is a cross-sectional view of a second embodiment of the invention which includes a safety mechanism which has a restoring device.
Figure 7:
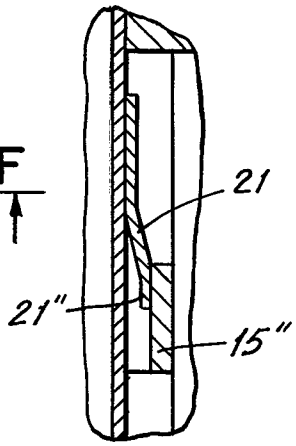
FIG. 7 is a cross-sectional view of a detail of the second embodiment of the fuse of the invention at an enlarged scale along plane G-H in FIG. 6.
Figure 6:
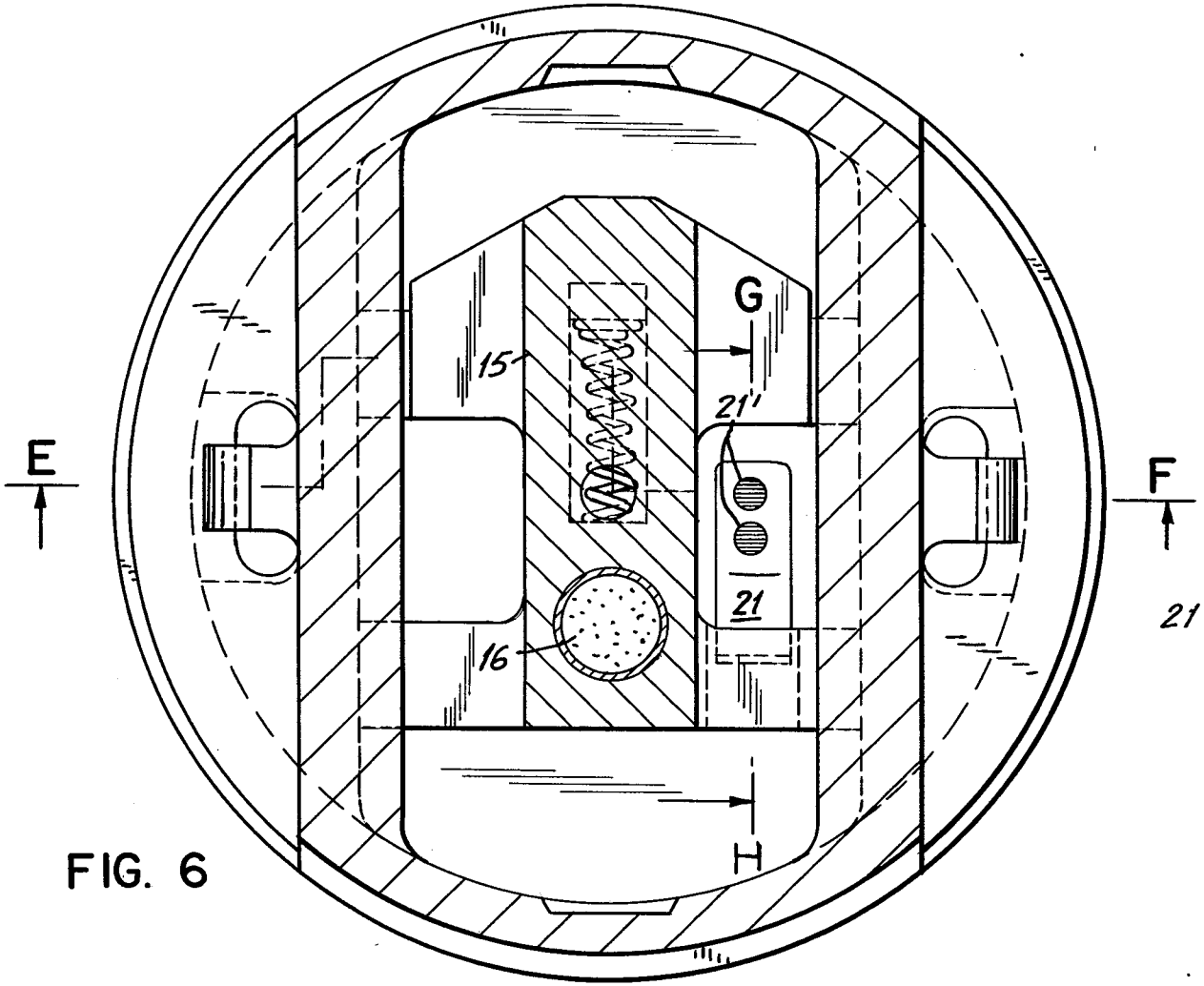
FIG. 6 is a cross-sectional view of the fuse of the second embodiment along plane C-D of FIG. 5.
Figure 8:
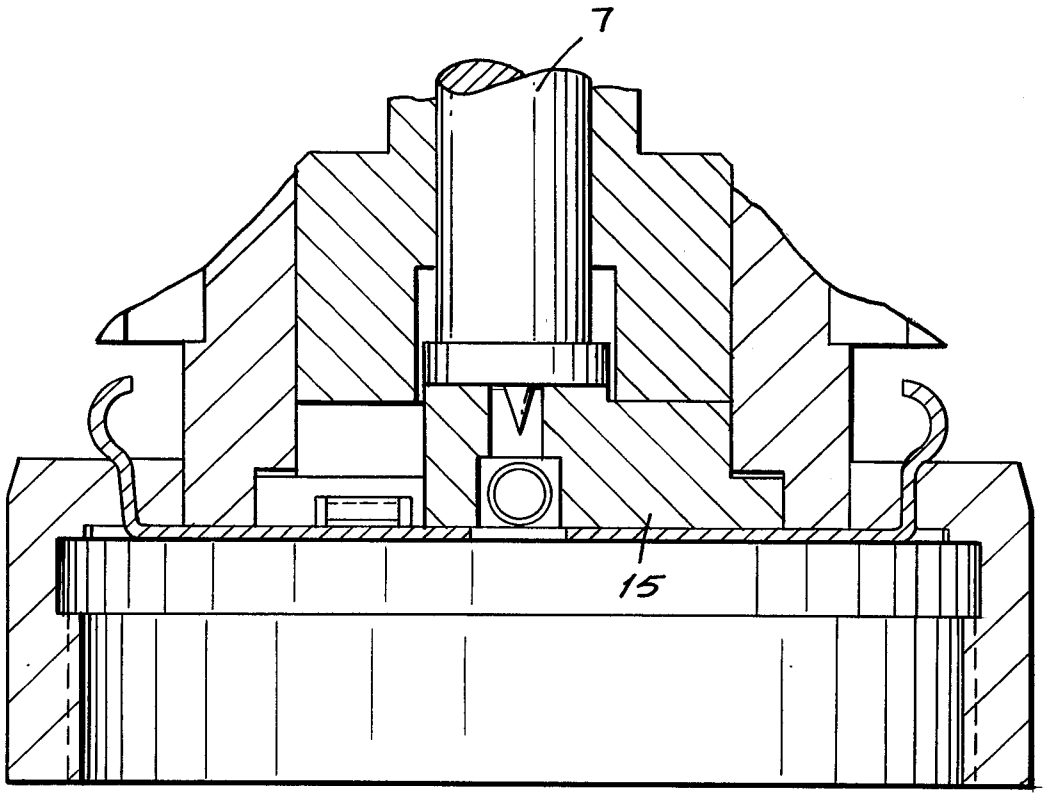
FIG. 8 is a partial cross-sectional view of the fuse of the second embodiment along the plane E-F of FIG. 6.
Figure 9:
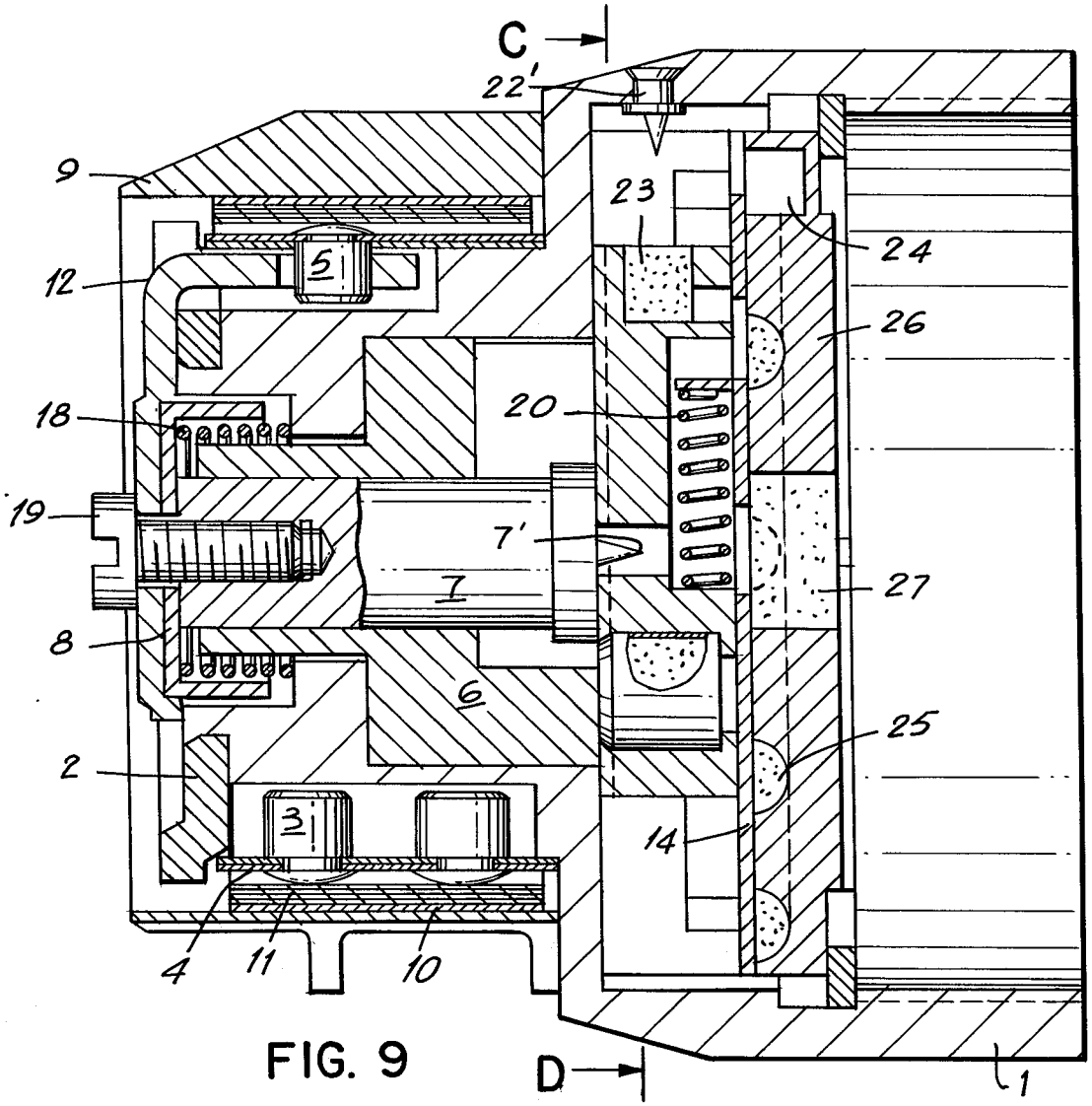
FIG. 9 is a cross-sectional view of a fuse in accordance with a third embodiment of the invention which includes a self-destruct device.
Figure 11:
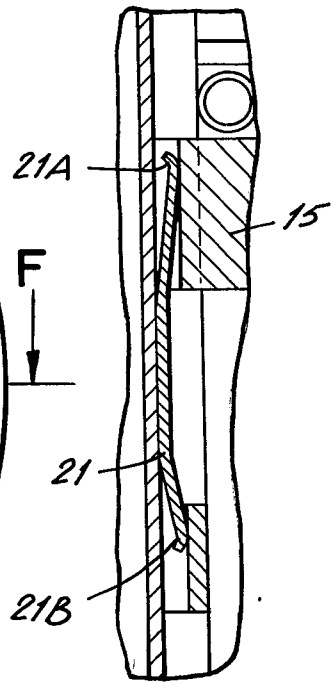
FIG. 11 is a cross-sectional view of a detail of the fuse of the third embodiment along plane G-H of FIG. 10.
Figure 10:
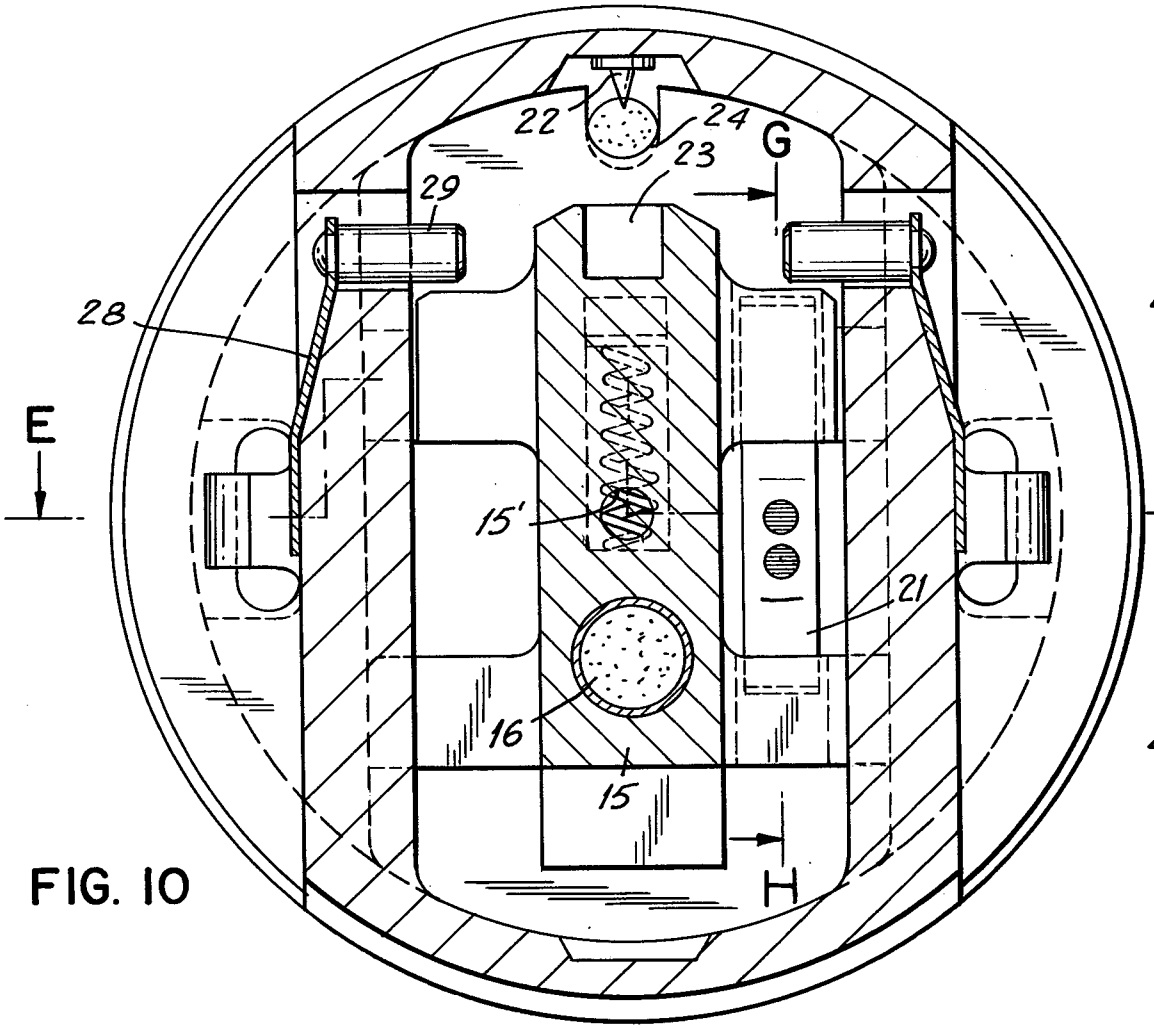
FIG. 10 is a cross-sectional view of the fuse of the third embodiment along plane C-D of FIG. 9.
Figure 12:
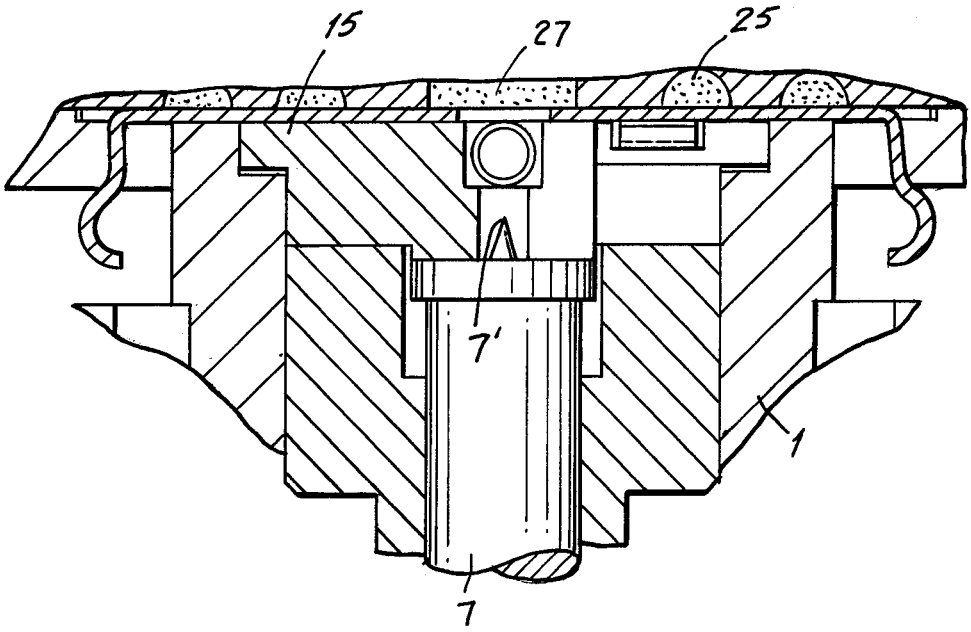
FIG. 12 is a partial cross-sectional view of the fuse of the third embodiment along plane E-F of FIG. 10.

In a further second embodiment, illustrated in FIGS. 5 to 7, there is shown a fuse which has operative characteristics that are even safer than those of the first embodiment. Those parts of the arrangement which correspond to or are equivalent to the parts referred to and described in the first embodiment have been designated with the same reference numbers. The fuse illustrated in cross section in FIG. 5 has a recess in the detonator support 15 in which a return spring 20 is laterally mounted relative to the longitudinal axis of the fuse. This return spring 20 bears, on the one hand, against the short leg of an angle 20' which is fixed to the housing cover 14 and, on the other hand, bears against a movably arranged detonator support 15. The support 15 moves, after release by the firing pin nose point 7' of the firing pin 7 by moving out of the through bore 15', as has been described with respect to the first embodiment, as a result of the influence of the centrifugal force, against the action of the return spring 20, into the ignition position, in which position the detonator 16 is in alignment with the firing pin 7. When a predetermined maximum angle of the spring sheet metal blades 4, acting as a spin brake, is reached the remaining number of rotations of the satellite projectile can reach no more than a certain minimum number, which is selected to be so low, that a disadvantageous influence on the effective charge, which generally is a hollow charge, needs not to be considered. In the event there occurs a malfunctioning of the ignition (a dud) a readjustment of the safety is established, i.e. the operative armed position of the fuse is cancelled and the support 15 transferred into a blind position via the action of the spring 20, in which a risk-free removal of duds is possible. This effect is achieved as follows:

After the impacting of the non-ignited satellite projectile the possible remaining rotation is abruptly ended. The coil spring lifts the possibly partially penetrating ignition needle nose point 7' from the non-ignited detonator 16 so that now the return spring 20 can be unloaded and thereby slides the detonator support 15 back into an irreversible safety position, in which it is blocked by the locking spring 21 (FIGS. 6 and 7). In the simplest case the locking spring 21 consists of a sheet metal strip spring, which, on one side, is spot-welded to the housing, for example by means of welding spots 21', so as to be firmly joined with the housing 1. The free end 21'' of spring 21 is positioned so as to bear against a stop 15'' of the detonator support 15 to thereby block its return lateral movement when the stop 15'' has moved past the free end 21'' of the spring.

In a further third embodiment of the invention (FIGS. 9 to 12) there is provided a fuse construction including a self-destruct arrangement, which, at ignition malfunctioning of the detonator 16, still effects an ignition of the effective charge after a predetermined time-delay and thereby avoids even with greater safety the formation of dangerous duds.

In this embodiment the fuse of the satellite projectile is constructed in such a way that when the detonator support moves into the ignition position an ignition element, which is also disposed in the detonator support 15, is pushed against a second penetrating ignition needle 22 which is affixed to the housing 1 of the fuse, whereby a pyrotechnic ignition delay path is activated. After the expiration of the delay time this delay path effects, via a pyrotechnic ignition reinforcing member, an ignition of the effective charge of the satellite projectile, whereby the latter self-destructs with safety and no dud can be formed. The afore-described third embodiment of the fuse is illustrated in detail in FIGS. 9 to 12.

Those parts of the arrangement which correspond to or are equivalent to the parts referred to and described in the first and second embodiments have been designated with the same reference numbers.

The operation of the fuse of the third embodiment is as follows:

Prior to the unlocking of the ignition needle 7 two transverse pins 29, elastically secured to sheet metal spring plates 28 affixed to the housing cover 14, have been swung radially outwardly as a result of the centrifugal force applied to the detonator support 15 and the housing 1 thereby functioning like fly-bolts, thereby releasing the former, so that the support 15, after its release, can glide into the ignition position by moving the firing pin nose point 7' of the firing pin 7 into such ignition position, in which the detonator 16, disposed underneath the firing pin 7, aligns with the lifted firing pin 7. When the ignition position has been reached and a dud occurs due to malfunctioning, the ignition element 23 which is mounted in a mating recess in the detonator support 15, which is an additional charge arranged in the detonator support 15 and is to ignite when, pushed against a further ignition needle 22 fixed to the housing 1. In order to avoid, that the gases formed thereby return the detonator support 15 from the ignition position reached in the afore-described manner, the end 21A of a double locking spring 21, which confronts the second ignition needle 22 engages with the detonator support 15 in such a way, that such return movement is no longer possible. The pyrotechnic delay ignition path 25, which is ignited by the ignition element 23 via an ignition transfer member 24, ignites after the termination of its combustion time, an ignition transfer member 27 which thereafter automatically detonates the explosive material of the effective charge of the satellite projectile, which is at a point in time that is after the impacting of the satellite projectile on the target region.

If during the storage or during the transport of the satellite projectile there occurs a manipulation of the fuse which causes the firing pin 7 to be unintentionally pulled out from the secure engagement in the detonator support 15, the return spring 20 slides the detonator support 15 into an irreversible blind position, in which the detonator support is continuously blocked by the other end 21B of the locking spring 21.

Although the invention is described and illustrated with reference to a plurality of embodiments thereof, it is to be expressly understood that it is in no way limited to the disclosure of such preferred embodiments but is capable of numerous modifications within the scope of the appended claims.

We claim:

1. An improved fuse for a satellite projectile having a housing and a first ignition needle axially movably mounted in said housing, a wound band safety means operatively mounted in said housing, a detonator support having a main detonator charge laterally movably mounted relative to said first ignition needle, said detonator support being movable from a safety position to an armed position due to the action of a centrifugal force caused by the spin of said satellite projectile, the improvement comprising, a key-shaped cover having a first transverse wall portion and a second peripheral wall portion and being movably mounted in said fuse relative to said housing;

said ignition needle being centrally mounted in said housing and being connected to said key-shaped cover;

said key-shaped cover having at least one first recess in said second peripheral wall portion;

a sheet metal spring being fixedly mounted on said housing and having a free end;

at least one locking pin being secured to said sheet metal spring and extending into said first recess of said key-shaped cover, the free end of said sheet metal spring swinging radially outwardly under the influence of centrifugal forces caused by the spin of the projectile, and including a first coil spring coaxially mounted about at least a portion of said hollow cylinder; one end of said coil spring contacting said housing and the other end of said coil spring biasing said ignition needle away from said support member whereby said locking pin is moved out of said first recess by said first coil spring a defined axial movement to release said ignition needle and key-shaped cover.

2. The improved fuse for a satellite projectile as set forth in claim 1, including a percussion mass concentrically surrounding said ignition needle.

3. The improved fuse for a satellite projectile as set forth in claim 2, wherein said percussion mass is constructed as a hollow cylinder having a stepped outer diameter.

4. The improved fuse for a satellite projectile as set forth in claim 3, wherein said detonator support has a second recess extending transversely relative to longitudinal axis of said fuse, a second coil spring being mounted in said second recess and having one free end abutting against said housing and the other free end radially biasingly contacting said support member relative to the longitudinal axis of said fuse to urge the detonator support radially inwardly.

5. The improved fuse for a satellite projectile as set forth in claim 4, including a blocking spring fixedly mounted on said housing and having a first free end which selectively extends into the path of movement of said detonator support when the latter has reached an extreme radially outer position to block a radially inner movement thereafter.

6. The improved fuse for a satellite projectile as set forth in claim 5, including a secondary ignition needle fixedly mounted on the interior wall of said housing and extending into the path of movement of the detonator support, said detonator support having a radially outer end face, a third recess disposed in said radially outer end face, an ignition element mounted in said third recess, a pyrotechnic delay ignition means operatively mounted in said detonator support and an ignition transfer member operatively mounted in said detonator support, said pyrotechnic delay ignition means ignitingly connecting said ignition element with said ignition transfer member so that when the ignition of said main detonating charge by said first ignition needle malfunctions said secondary needle upon penetrating said ignition element ignites said ignition transfer member via said pyrotechnic delay ignition means.

7. The improved fuse for a satellite projectile as set forth in claim 6, wherein said blocking spring has or second free end, said first and second free ends gliding over a portion of the surface of said detonator support and then snapping into a blocking position wherein said first free end of said blocking spring selectively blocks said detonator support in a first extreme armed position and said second free end of said blocking spring selectively blocks said detonator support in an extreme blind position.

8. The improved fuse for a satellite projectile as set forth in claim 7, including a transport safety ring and a safety band concentrically surrounding said wound band safety means during transport and storage of said satellite projectile.

9. The improved fuse for a satellite projectile as set forth in claim 8, a pair of sheet metal support springs being fixedly secured at one of their ends to said housing and having a fly bolt secured to their respective free ends which are adapted to swing radially outwardly, from a blocking position in which they at least temporarily block the radially slidable outward movement of said detonator support to release said slidable movement of the detonator support.

* * * * *